US006824352B1

(12) United States Patent
Moore et al.

(10) Patent No.: US 6,824,352 B1
(45) Date of Patent: Nov. 30, 2004

(54) VANE ENHANCED TRAILING EDGE COOLING DESIGN

(75) Inventors: Robert P. Moore, Palm City, FL (US); Richard Seleski, Palm Beach Gardens, FL (US); Dale Lee Cox, Jupiter, FL (US)

(73) Assignee: Power Systems Mfg, LLC, Jupiter, FL (US)

( * ) Notice: Subject to any disclaimer, the term of this patent is extended or adjusted under 35 U.S.C. 154(b) by 0 days.

(21) Appl. No.: 10/673,311

(22) Filed: Sep. 29, 2003

(51) Int. Cl.[7] ..... F01D 9/06
(52) U.S. Cl. ..... 415/115
(58) Field of Search ..... 415/115, 116, 415/96 R, 96 A, 97 R

(56) References Cited

U.S. PATENT DOCUMENTS 3,809,494 A 5/1974 Redman
3,846,041 A * 11/1974 Albani ..... 416/97 R
4,407,632 A * 10/1983 Liang ..... 416/97 R
4,515,523 A 5/1985 North et al.
4,515,526 A * 5/1985 Levengood ..... 416/96 R
4,946,346 A * 8/1990 Ito ..... 415/115
5,601,399 A 2/1997 Okpara
5,772,397 A 6/1998 Morris et al.
6,142,734 A 11/2000 Lee
6,179,565 B1 * 1/2001 Palumbo et al. ..... 416/97 R
6,402,470 B1 6/2002 Kvasnak et al.
6,602,047 B1 * 8/2003 Barreto et al. ..... 415/115
2004/0062636 A1 * 4/2004 Mazzola et al. ..... 415/115

* cited by examiner

*Primary Examiner*—Christopher Verdier
(74) *Attorney, Agent, or Firm*—Brian R. Mack

(57) ABSTRACT

There is provided a gas turbine vane with an airfoil cooling circuit incorporating multiple generally radially extending rows of pedestals generally bisected by a plurality of axially extending ribs with the ribs containing a plurality of recessed cavities. The recessed cavities are positioned immediately adjacent pedestals located closest to the ribs such that a cavity passageway is formed to pass sufficient cooling air between the rib and pedestal to increase overall heat transfer and reduce pressure loss of the cooling fluid.

26 Claims, 3 Drawing Sheets

VANE ENHANCED TRAILING EDGE COOLING DESIGN

TECHNICAL FIELD

This invention relates to a vane of a gas turbine engine and more specifically to a configuration that provides improved heat transfer to the trailing edge region of the vane while minimizing pressure loss to the cooling fluid.

BACKGROUND OF THE INVENTION

As performance requirements for gas turbine engines increase, operating temperatures increase as well, especially in the turbine section. While technological advancements have been made in many areas including material capability and thermal barrier coating systems to withstand these higher operating temperatures, it is also desirable to obtain as efficient cooling of the component as possible. In a gas turbine engine, the turbine section is comprised of alternating rows or stages of vanes and blades, where the vanes remain stationary and the blades rotate about the engine axis. The vanes serve to direct the flow of hot gases to the next stage aft of a turbine, onto a set of rotating blades. The orientation at which this flow of hot gases is directed is critically important to the overall turbine performance and blade life. Therefore, it is necessary to ensure that the vane trailing edge shape is maintained and proper cooling of the vane trailing edge is one means to accomplish this objective.

Prior art turbine vanes have incorporated pedestals or pin fins in the vane walls to aid in cooling and heat transfer by causing turbulation in the wake regions generated by cooling fluid passing around the pedestals or pin fins. These pedestals are often times located towards the vane trailing edge. A prior art example of vane trailing edge cooling utilizing pin fins is disclosed in U.S. Pat. No. 4,515,523 where pin fins are added to the rib walls that extend longitudinally to the trailing edge for increased stiffness. These additional pin fins serve to replace those eliminated due to the placement of longitudinal ribs. However, the placement of these additional pin fins along the rib wall causes additional pressure loss to the cooling flow. The present invention seeks to overcome the shortcomings of the prior art by providing a vane trailing edge region having the required stiffness through longitudinal ribs and improved heat transfer associated with pin fins while reducing the pressure loss to the cooling flow. The reduced pressure loss along the rib wall is a result of repositioning the pedestals closer to the rib walls in conjunction with incorporating recessed cavities in the rib walls in areas immediately adjacent to the pedestals.

SUMMARY AND OBJECTS OF THE INVENTION

The present invention provides a gas turbine vane having first and second platforms in spaced relation, an airfoil extending between the platforms, with the airfoil containing one or more cooling circuits. The cooling circuit has a row of first pedestals having a first diameter, one or more rows of second pedestals having a second diameter and spaced a first distance axially from the first pedestals and offset radially a second distance, and one or more rows of third pedestals having a third diameter and spaced a third distance axially from the second pedestals and offset radially a fourth distance. A plurality of generally axially extending ribs are incorporated with the ribs bisecting the rows of first, second, and third pedestals, and with the ribs having at least one recessed cavity in each of its upper and lower walls. The recessed cavities are positioned immediately adjacent second and third pedestals located closest to the ribs such that a cavity passageway is formed to pass sufficient cooling fluid between the rib and pedestal. The recessed cavities allow for closer positioning of pedestals to the rib to enhance the overall heat transfer while minimizing pressure loss.

It is an object of the present invention to provide a vane for a gas turbine engine having improved heat transfer and reduced pressure loss to the cooling fluid.

In accordance with these and other objects, which will become apparent hereinafter, the instant invention will now be described with particular reference to the accompanying drawings.

DETAILED DESCRIPTION OF THE PREFERRED EMBODIMENT

Figure 1:
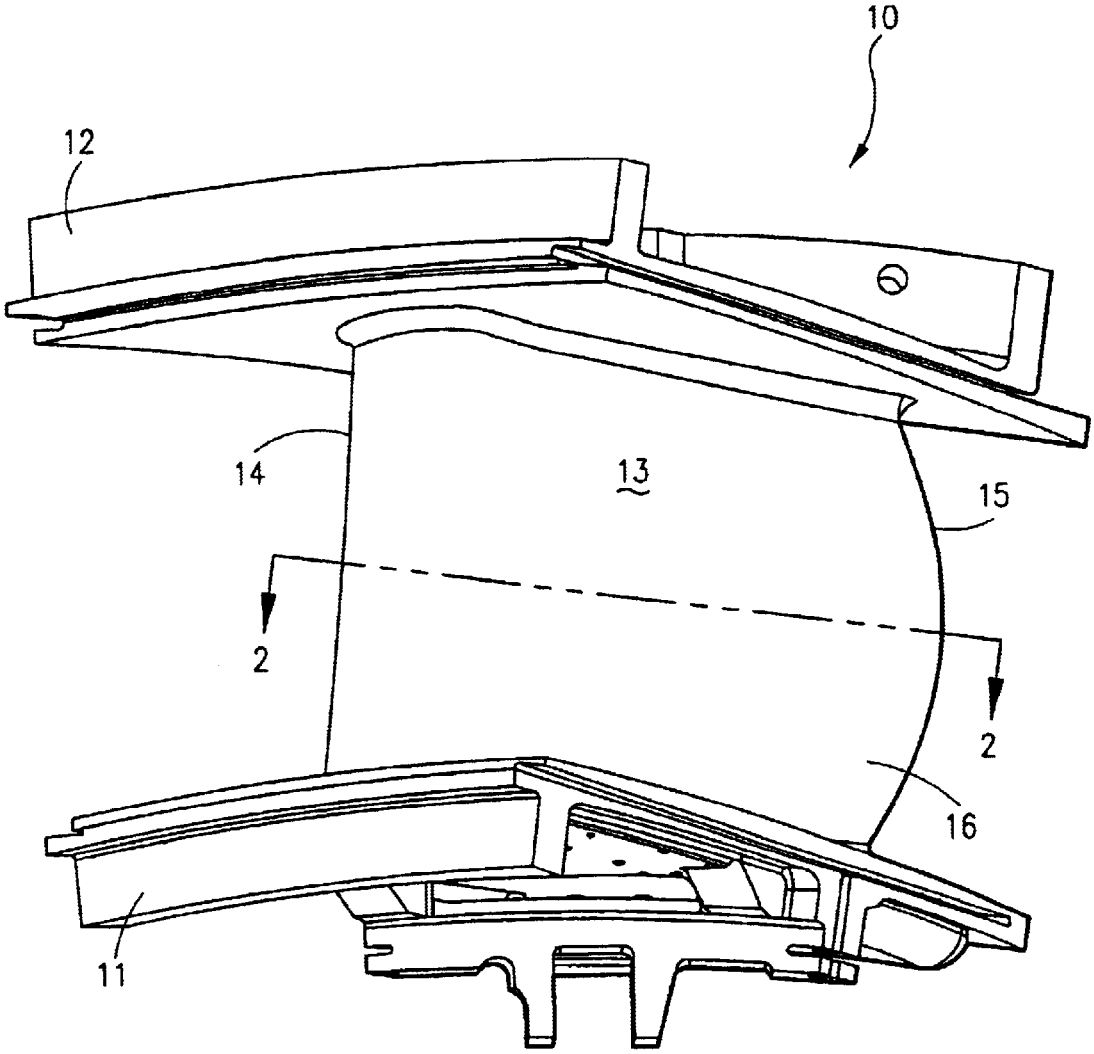
FIG. 1 is a perspective view of a gas turbine vane incorporating the present invention.
Figure 2:
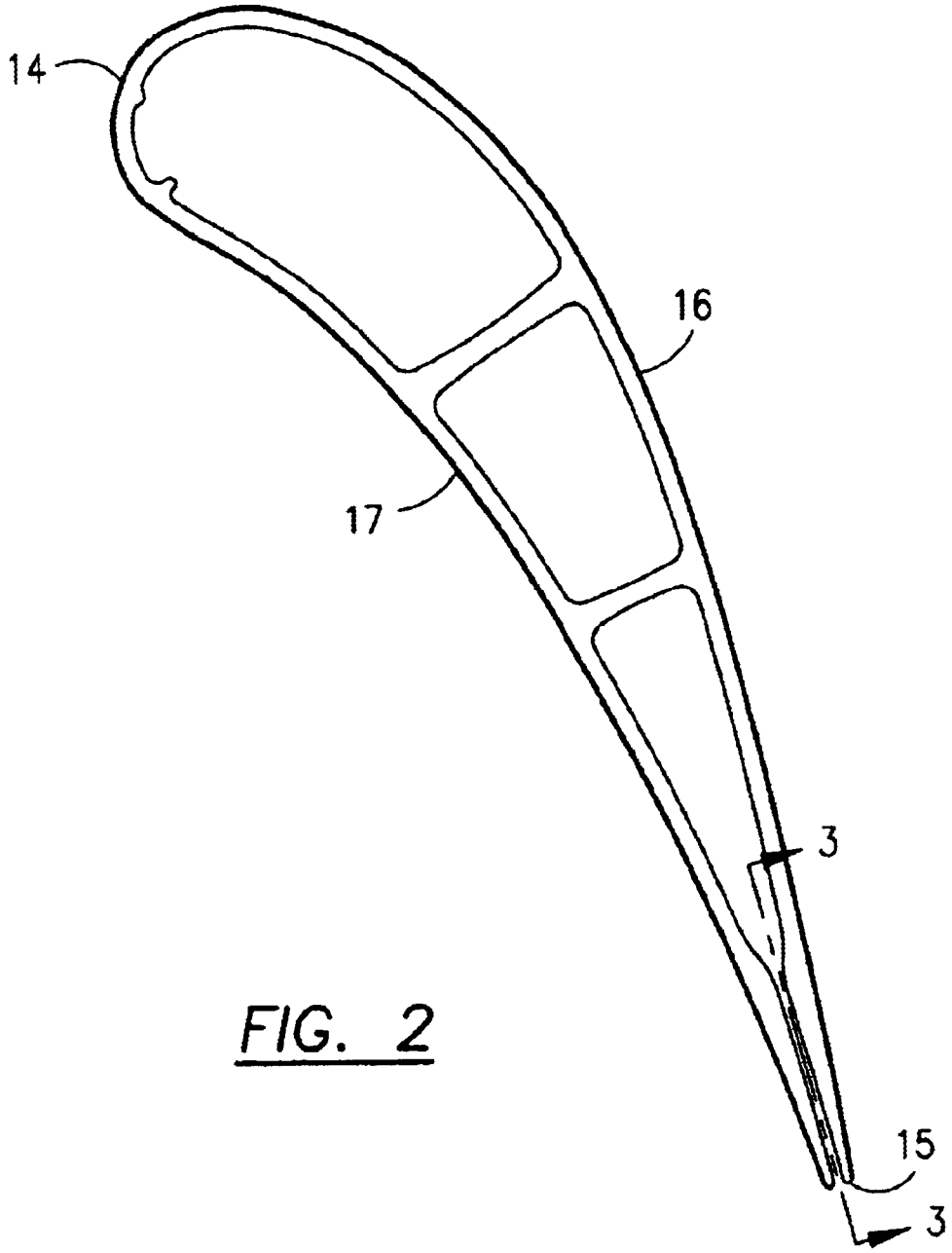
FIG. 2 is a cross section view of the airfoil portion of a gas turbine vane incorporating the present invention.

Referring to FIG. 1, a cooled gas turbine vane 10 incorporating the present invention is shown in perspective view. Turbine vane 10 comprises a first platform 11 and a second platform 12 in spaced relation with second platform 12 radially outward of first platform 11. Extending radially between first platform 11 and second platform 12 is an airfoil 13 having a leading edge 14 and trailing edge 15 that are each generally perpendicular to first platform 11 and second platform 12. Referring now to FIG. 2, leading edge 14 and trailing edge 15 are connected to form airfoil 13 by a first wall 16 and second wall 17.

Figure 3:
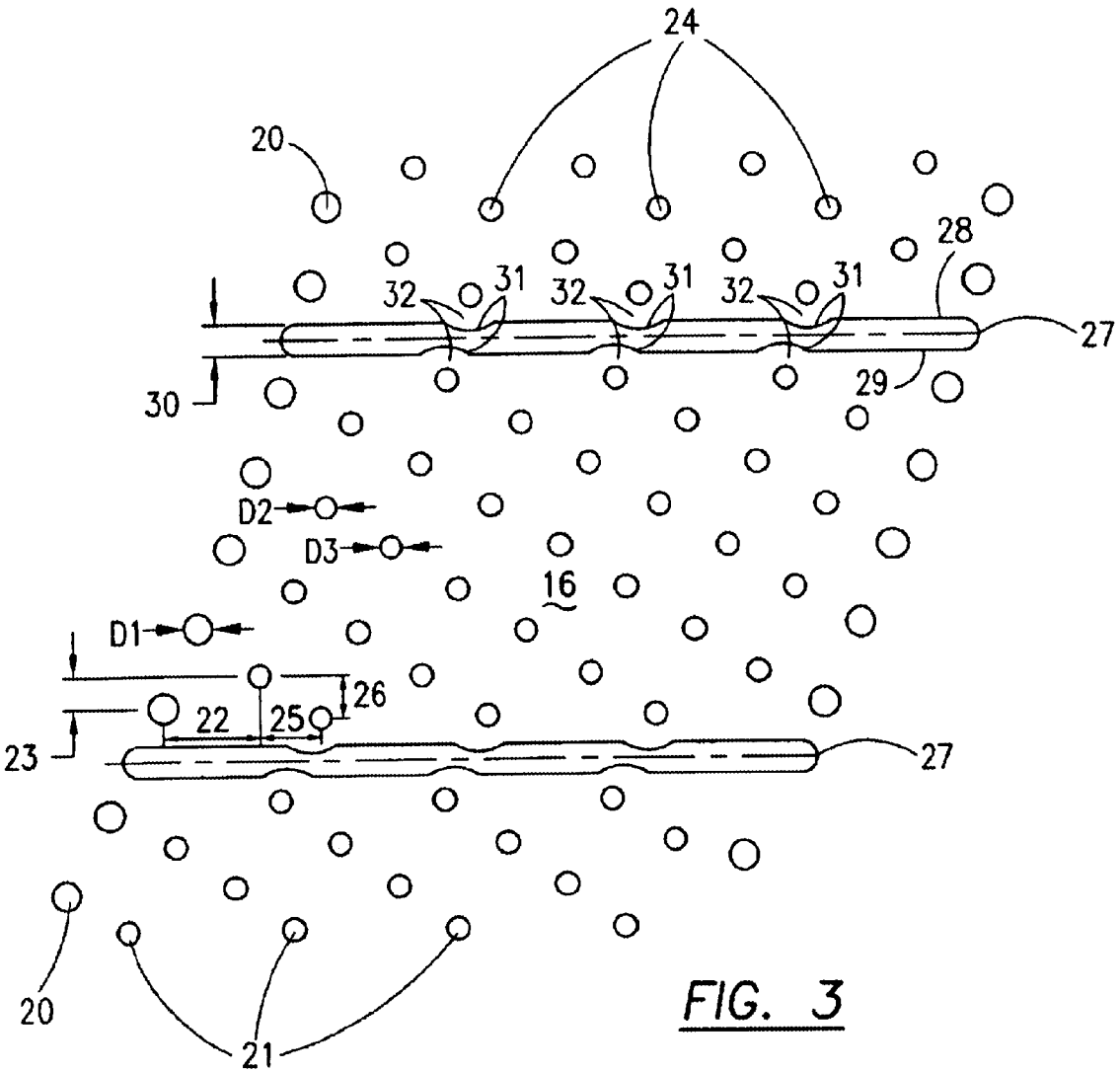
FIG. 3 is a partial plane view of the trailing edge region of a gas turbine vane incorporating the present invention.

Due to the high operating temperatures of the turbine environment, airfoil 13 contains one or more cooling circuits between first wall 16 and second wall 17. A portion of a typical cooling circuit is shown in FIG. 3 with the cooling circuit comprising a row of first pedestals 20 extending generally radially outward with first pedestals 20 each having a first diameter D1 and extending between first wall 16 and second wall 17. Adjacent the row of first pedestals 20 is one or more rows of second pedestals 21 extending generally radially outward with second pedestals 21 each having a second diameter D2 and extending between first wall 16 and second wall 17. Second pedestals 21 are spaced axially a first distance 22 from first pedestals 20 and offset radially a second distance 23 from first pedestals 20. Adjacent the row of second pedestals 21 is one or more rows of third pedestals 24 extending generally radially outward with third pedestals 24 each having a third diameter D3 and extending between first wall 16 and second wall 17. Third pedestals 24 are spaced axially a third distance 25 from second pedestals 21 and offset radially a fourth distance 26 from second pedestals 21. In the preferred embodiment, first diameter D1 of first pedestals 20 is at least 0.060 inches, second diameter D2 of second pedestals 21 is at least 0.040 inches, and third diameter D3 of third pedestals 24 is at least 0.040 inches. Depending on the cooling requirements of the turbine vane second diameter D2 can be equal to third diameter D3, but first diameter D1 is greater than second diameter D2 and third diameter D3. For optimized heat transfer throughout the cooling circuit is desirable for first distance 22 to be greater than second distance 23 and third distance 25 to be greater than fourth distance 26.

In the preferred embodiment of the present invention, multiple rows of second and third pedestals are utilized in an alternating pattern. Depending on the axial length of the cooling circuit and vane cooling requirements, the quantity of rows and number of pedestals per row can vary. Due to the complexity of casting turbine vane 10 and the tight positional tolerances for the pedestals, all rows of pedestals are integrally cast into the vane.

Another feature integrally cast into the turbine vane and spaced accordingly to provide increased stiffness to trailing edge 15 is a plurality of ribs 27. Ribs 27 extend axially, generally bisecting rows of first, second, and third pedestals and have an upper wall 28 and a lower wall 29 in spaced relation thereby forming a rib thickness 30 therebetween. In the regions of the cooling circuit where second and third pedestals, 21 and 24, are positioned immediately adjacent ribs 27, a recessed cavity 31 is formed in rib walls 28 and 29 such that a cavity passageway 32 is provided to allow for sufficient cooling air to pass around the pedestals, thereby increasing the heat transfer through turbulation in the wake of the pedestal, while minimizing the pressure loss associated with the cooling air passing between the pedestal and rib 27. In the preferred embodiment of the present invention, rib thickness 30 is at least 0.060 inches and recessed cavity 31 extends into rib 27 a maximum of 25% of rib thickness 30. The pedestals are positioned such that the opening created by passageway 32 is equal to the diameter of the adjacent pedestal. This will ensure that the passageway is large enough to pass the required cooling fluid to provide sufficient heat transfer along the rib region of the cooling circuit. For the preferred embodiment, compressed air serves as the cooling fluid. However, one skilled in the art of turbine airfoil cooling will understand other fluid mediums may be acceptable depending on turbine operating conditions.

While prior art configurations attempted to yield this same heat transfer affect through the addition of pedestals to the rib walls, a loss in cooling fluid pressure occurred due to the turbulence of the cooling fluid along this rib wall geometry. In the preferred embodiment of the present invention, the heat transfer throughout the region along ribs 27 is improved by the ability to position pedestals adjacent ribs 27 through the use of recessed cavities 31 and cavity passageways 32 such that the cooling flow pressure loss associated with passing through cavity passageways is minimized. While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A cooled gas turbine vane comprising:

a first platform and a second platform in spaced relation with said second platform radially outward from said first platform;

an airfoil extending radially between said first and second platforms, said airfoil having a leading edge and trailing edge, each generally perpendicular to said first and second platforms, and a first wall and second wall extending between said leading edge and said trailing edge;

one or more cooling circuits disposed between said first and second walls, each of said cooling circuits having:

a row of first pedestals extending generally radially outward, said first pedestals extending between said first wall and said second wall and having a first diameter;

one or more rows of second pedestals extending generally radially outward, said second pedestals extending between said first wall and said second wall, and having a second diameter, said second pedestals spaced a first distance axially from said first pedestals and offset radially a second distance from said first pedestals;

one or more rows of third pedestals extending generally radially outward, said third pedestals extending between said first wall and said second wall, and having a third diameter, said third pedestals spaced a third distance axially from said second pedestals and offset radially a fourth distance from said second pedestals;

a plurality of axially extending ribs, said ribs generally bisecting said rows of first, second, and third pedestals, said ribs having an upper wall and a lower wall in spaced relation thereby forming a rib thickness therebetween, said ribs having at least one recessed cavity in said upper wall and said lower wall;

wherein pedestals positioned immediately adjacent said recessed cavity of said ribs are separated from said recessed cavity by a cavity passageway.

2. The cooled gas turbine vane of claim 1 wherein said first diameter of said first pedestals is at least 0.060 inches.

3. The cooled gas turbine vane of claim 1 wherein said second diameter of said second pedestals is at least 0.040 inches.

4. The cooled gas turbine vane of claim 1 wherein said third diameter of said third pedestals is at least 0.040 inches.

5. The cooled gas turbine vane of claim 1 wherein said second diameter of said second pedestals is equal to said third diameter of said third pedestals.

6. The cooled gas turbine vane of claim 1 wherein said first diameter is greater than said second diameter and said third diameter.

7. The cooled gas turbine vane of claim 1 wherein said first distance is greater than said second distance.

8. The cooled gas turbine vane of claim 1 wherein said third distance is greater than said fourth distance.

9. The cooled gas turbine vane of claim 1 wherein said rib thickness is at least 0.060 inches.

10. The cooled gas turbine vane of claim 9 wherein said recessed cavity extends into said rib a maximum of 25% of said rib thickness.

11. The cooled gas turbine vane of claim 1 wherein said cavity passageway is equal to the diameter of said adjacent pedestal.

12. The cooled gas turbine vane of claim 1 wherein said pedestals positioned immediately adjacent said recessed cavity is one or more second pedestals.

13. The cooled gas turbine vane of claim 1 wherein said pedestals positioned immediately adjacent said recessed cavity is one or more third pedestals.

14. A cooling circuit disposed between a first wall and a second wall of a gas turbine airfoil, said cooling circuit comprising:

a row of first pedestals extending generally radially outward, said first pedestals extending between said first wall and said second wall and having a first diameter;

one or more rows of second pedestals extending generally radially outward, said second pedestals extending between said first wall and said second wall, and having a second diameter, said second pedestals spaced a first distance axially from said first pedestals and offset radially a second distance from said first pedestals;

one or more rows of third pedestals extending generally radially outward, said third pedestals extending between said first wall and said second wall, and having a third diameter, said third pedestals spaced a third distance axially from said second pedestals and offset radially a fourth distance from said second pedestals;

a plurality of axially extending ribs, said ribs generally bisecting said rows of first, second, and third pedestals, said ribs having an upper wall and a lower wall in spaced relation thereby forming a rib thickness therebetween, said ribs having at least one recessed cavity in said upper wall and said lower wall;

wherein pedestals positioned immediately adjacent said recessed cavity of said ribs are separated from said recessed cavity by a cavity passageway.

15. The cooled gas turbine vane of claim 14 wherein said first diameter of said first pedestals is at least 0.060 inches.

16. The cooled gas turbine vane of claim 14 wherein said second diameter of said second pedestals is at least 0.040 inches.

17. The cooled gas turbine vane of claim 14 wherein said third diameter of said third pedestals is at least 0.040 inches.

18. The cooled gas turbine vane of claim 14 wherein said second diameter of said second pedestals is equal to said third diameter of said third pedestals.

19. The cooled gas turbine vane of claim 14 wherein said first diameter is greater than said second diameter and said third diameter.

20. The cooled gas turbine vane of claim 14 wherein said first distance is greater than said second distance.

21. The cooled gas turbine vane of claim 14 wherein said third distance is greater than said fourth distance.

22. The cooled gas turbine vane of claim 14 wherein said rib thickness is at least 0.060 inches.

23. The cooled gas turbine vane of claim 22 wherein said recessed cavity extends into said rib a maximum of 25% of said rib thickness.

24. The cooled gas turbine vane of claim 14 wherein said cavity passageway is equal to the diameter of said adjacent pedestal.

25. The cooled gas turbine vane of claim 14 wherein said pedestals positioned immediately adjacent said recessed cavity is one or more second pedestals.

26. The cooled gas turbine vane of claim 14 wherein said pedestals positioned immediately adjacent said recessed cavity is one or more third pedestals.

* * * * *